US010030841B2

(12) United States Patent
Wang et al.

(10) Patent No.: US 10,030,841 B2
(45) Date of Patent: Jul. 24, 2018

(54) ZOOM SPOTLIGHT

(71) Applicant: JRF Photonics Tech. Co., Ltd., Tianjin (CN)

(72) Inventors: Chiu-Fen Wang, Taoyuan (TW); Xuan-Hao Lee, Taoyuan (TW); Che-Chu Lin, Taoyuan (TW)

(73) Assignee: JRF PHOTONICS TECH. CO., LTD., Tianjin (CN)

( * ) Notice: Subject to any disclaimer, the term of this patent is extended or adjusted under 35 U.S.C. 154(b) by 205 days.

(21) Appl. No.: 14/618,065

(22) Filed: Feb. 10, 2015

(65) Prior Publication Data

US 2016/0230953 A1 Aug. 11, 2016

(51) Int. Cl.

| | |
|---|---|
| ***F21S 8/00*** | (2006.01) |
| ***F21V 5/04*** | (2006.01) |
| ***F21V 13/04*** | (2006.01) |
| ***F21V 5/00*** | (2018.01) |
| ***F21V 14/06*** | (2006.01) |
| *F21V 29/70* | (2015.01) |
| *F21V 11/16* | (2006.01) |
| *F21V 13/02* | (2006.01) |
| *F21V 13/12* | (2006.01) |
| *F21Y 115/10* | (2016.01) |
| *F21Y 115/15* | (2016.01) |

(52) U.S. Cl.

CPC ..... *F21V 5/04* (2013.01); *F21V 5/008* (2013.01); *F21V 5/048* (2013.01); *F21V 13/04* (2013.01); *F21V 14/06* (2013.01); *F21V 11/16* (2013.01); *F21V 13/02* (2013.01); *F21V 13/12* (2013.01); *F21V 29/70* (2015.01); *F21Y 2115/10* (2016.08); *F21Y 2115/15* (2016.08)

(58) Field of Classification Search

CPC . F21V 5/04; F21V 5/008; F21V 29/70; F21V 13/04; F21V 14/06; F21V 1/12; F21V 1/16; F21V 1/143; F21V 5/048; F21W 2131/406; F21S 10/00; F21S 10/005; F21Y 2101/02

See application file for complete search history.

(56) References Cited

U.S. PATENT DOCUMENTS 2,253,409 A * 8/1941 Yost ..... F21V 5/008 362/268
4,101,957 A * 7/1978 Chang ..... F21V 9/04 362/268
4,151,584 A * 4/1979 Labrum ..... F21V 7/0025 362/302
5,345,371 A * 9/1994 Cunningham ..... F21V 7/09 362/297
6,249,375 B1 * 6/2001 Silhengst ..... B61L 5/1836 116/63 R
8,075,162 B2 * 12/2011 Falicoff ..... F21V 14/04 362/277

(Continued)

*Primary Examiner* — Peggy Neils
*Assistant Examiner* — Erin Kryukova
(74) *Attorney, Agent, or Firm* — Juan Carlos A Marquez; Marquez IP Law Office, PLLC

(57) ABSTRACT

A zoom spotlight has a reflector, a light source, a fixed lens, and a movable lens. The movable lens of the zoom spotlight can be moved and thereby adjusted in position relative to the fixed lens so that the zoom spotlight can output a broad beam, a collimated beam, or a beam ranging between the broad beam and the collimated beam, according to the user's needs.

8 Claims, 7 Drawing Sheets

(56) References Cited

U.S. PATENT DOCUMENTS

| | | | | |
|---|---|---|---|---|
| 2012/0121244 | A1* | 5/2012 | Stavely | F21V 5/007 396/175 |
| 2015/0362147 | A1* | 12/2015 | Schouboe | F21V 5/007 362/237 |
| 2016/0054502 | A1* | 2/2016 | Sun | G02B 6/0025 362/235 |

* cited by examiner

ZOOM SPOTLIGHT

BACKGROUND OF THE INVENTION

1. Technical Field

The present invention relates to a spotlight and more particularly to a zoom spotlight with a fixed lens and a movable lens.

2. Description of Related Art

The market demand for energy-saving products is increasing with the modernization of society and the rise of environmental awareness. Meanwhile, rapid development of the light-emitting diode (LED) and organic light-emitting diode (OLED) industry has lowered the costs of LEDs and OLEDs significantly, turning these lighting elements into the mainstream of energy-saving illumination.

In particular, LEDs and OLEDs are widely used in spotlights, especially high-power LED spotlights, which are nowadays the principal products in spotlight applications. The conventional spotlights, which feature high power consumption and tend to generate heat easily, have given way to high-power LED spotlights in such fields as special lighting, search and rescue, stage and runway design, and automotive lighting.

However, the market is still in want of a high-power LED spotlight which can directly output a broad beam, a collimated beam, or a beam ranging between the broad beam and the collimated beam, let alone a high-power LED spotlight capable of zooming.

On the other hand, most of the conventional spotlights require a complicated manufacturing process in mass production, and the finished spotlights are simply incapable of outputting an approximately collimated beam, meaning stray light will be generated during operation and thus compromise efficiency of use.

It is therefore highly desirable in the LED, OLED, and spotlight application-related industries to have a useful, low-cost yet high-quality, compact zoom spotlight which can be easily manufactured from simple optical and mechanical components without using expensive equipment, and which can output a broad and uniform beam in a broad beam mode and an approximately collimated beam without stray light in a collimated beam mode.

BRIEF SUMMARY OF THE INVENTION

The present invention provides a zoom spotlight which has a light source, a reflector, a fixed lens, and a movable lens. The movable lens of the zoom spotlight can be moved in order to be adjusted in position relative to the fixed lens so that the zoom spotlight can output a broad beam, a collimated beam, or a beam ranging between the broad beam and the collimated beam to meet the user's needs.

More specifically, the present invention provides a zoom spotlight which includes a reflector, a light source, a fixed lens, and a movable lens. The reflector has a central axis, a light exit opening, and a bottom side opposite the light exit opening. The central axis is the line connecting the center point of the light exit opening and the center point of the bottom side. The light source is fixedly provided at the bottom side and is located on the central axis. The fixed lens is fixedly provided at the light exit opening and is located in the reflector, with the axis of the fixed lens coinciding with the central axis. In addition, the periphery of the fixed lens is fixedly provided with a first light-blocking sleeve which extends toward the light source. The movable lens, on the other hand, is movably provided between the light source and the fixed lens and is located on the central axis. The periphery of the movable lens is fixedly provided with a second light-blocking sleeve which extends toward the light source.

Implementation of the present invention at least provides the following advantageous effects:

1. Structural simplicity, ease of manufacture, and low costs.
2. The ability to output a broad beam, a collimated beam, or a beam ranging between the broad beam and the collimated beam.

The features and advantages of the present invention are detailed hereinafter with reference to the preferred embodiments. The detailed description is intended to enable a person skilled in the art to gain insight into the technical contents disclosed herein and implement the present invention accordingly. In particular, a person skilled in the art can easily understand the objects and advantages of the present invention by referring to the disclosure of the specification, the claims, and the accompanying drawings.

BRIEF DESCRIPTION OF THE SEVERAL VIEWS OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
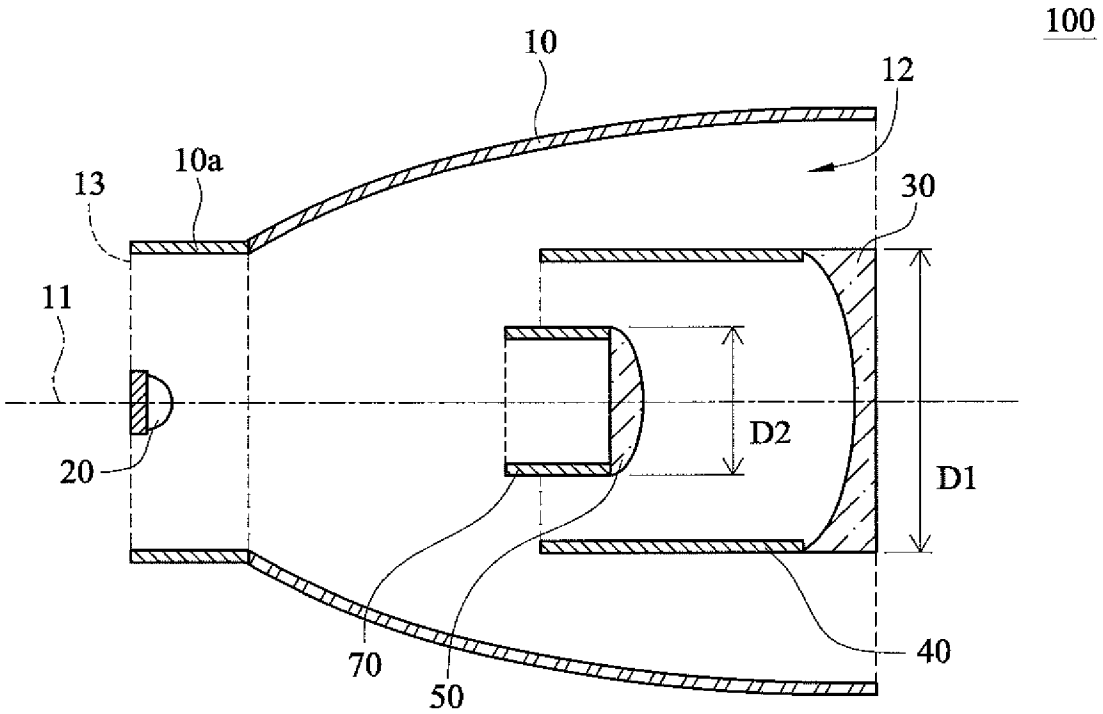
FIG. 1 is a schematic sectional view of the zoom spotlight in an embodiment of the present invention.

Referring to FIG. 1, the zoom spotlight 100 in an embodiment of the present invention includes a reflector 10, a light source 20, a fixed lens 30, and a movable lens 50.

As shown in FIG. 1, the reflector 10 has a central axis 11, a light exit opening 12, and a bottom side 13 opposite the light exit opening 12. The central axis 11 is the line connecting the center point of the light exit opening 12 and the center point of the bottom side 13. The shape or material of the reflector 10 is such that the inner surface of the reflector 10 can reflect incident light and project the reflected light out of the light exit opening 12 by method of approximate collimating beam or small divergence angle.

With continued reference to FIG. 1, the light source 20 is fixedly provided at the bottom side 13, located on the central axis 11, and opposite the light exit opening 12. The light source 20 can be at least one LED, at least one OLED, or a combination of at least one LED and at least one OLED. Depending on application requirements, the light emitted by the light source 20 can be of a single color (e.g., white, yellow, or any other color) or be a mixture of at least two color lights.

Referring again to FIG. 1, the fixed lens 30 is fixedly provided at the light exit opening 12 and is located in the reflector 10, with the axis of the fixed lens 30 in line with the central axis 11 of the reflector 10. Also, the periphery of the fixed lens 30 is fixedly provided with a first light-blocking sleeve 40 extending toward the light source 20.

The position where the fixed lens 30 is fixedly provided at the light exit opening 12 is so chosen that one surface of the fixed lens 30 is flush with the light exit opening 12 while the opposite surface of the fixed lens 30 is situated inside the reflector 10.

The fixed lens 30 can be a positive lens, a negative lens, a Fresnel lens, a liquid lens, a liquid crystal (LC) lens or a spatial light modulator (SLM) with phase modulation. The first light-blocking sleeve 40 can be formed of a light-absorbing material or a material with a frosted surface so that light projected from the light source 20 to the first light-blocking sleeve 40 will not penetrate or be reflected by the first light-blocking sleeve 40. Should such penetration or reflection take place, stray light traveling in arbitrary directions will occur.

As is well known in the art, a positive lens refers to a lens which produces a focused (i.e., converging) beam on the side of the lens that is opposite the side where the source light (e.g., collimated or approximately parallel rays of light) enters the lens in a direction parallel to the optical axis of the lens. A negative lens, on the other hand, refers to a lens which produces a diverging beam on the side of the lens that is opposite the side where the source light (e.g., collimated or approximately parallel rays of light) enters the lens in a direction parallel to the optical axis of the lens, and which produces a focused virtual image on the side of the lens where the source light enters the lens.

Figure 2:
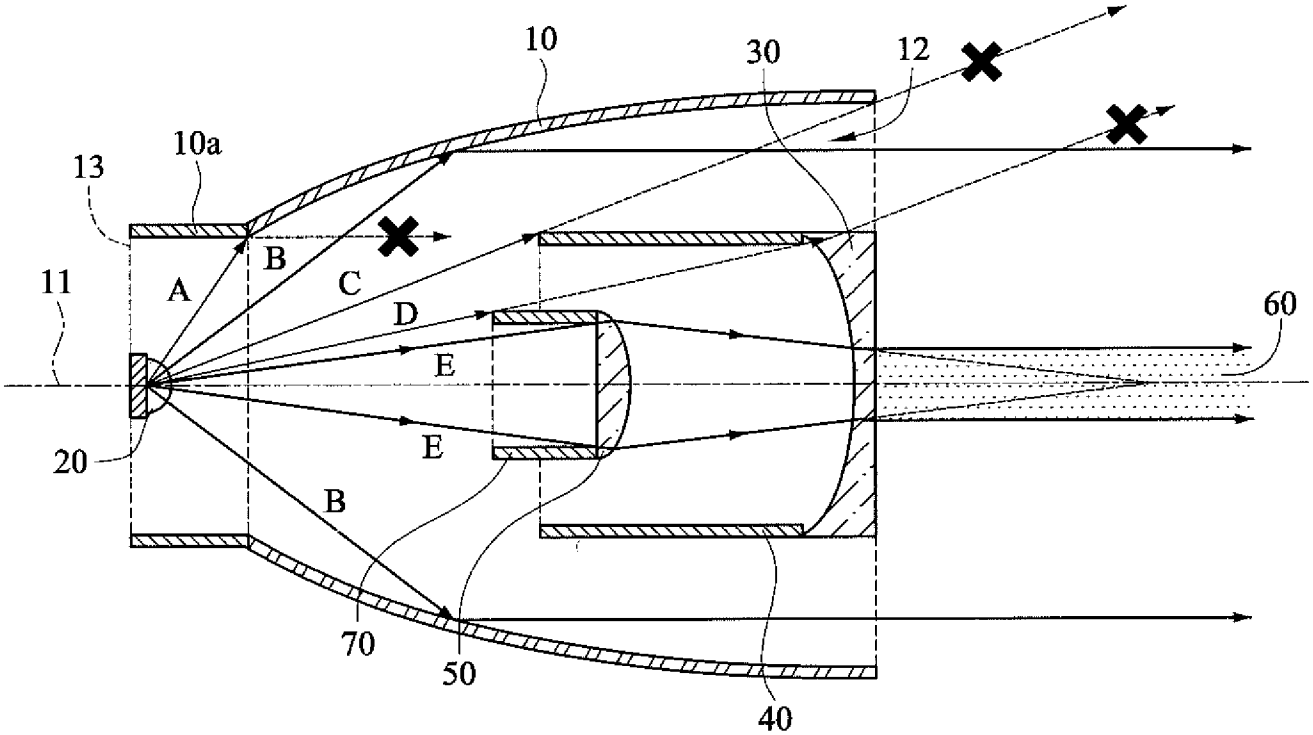
FIG. 2 schematically shows how light rays propagate from the light source of the zoom spotlight in an embodiment of the present invention.
Figure 3:
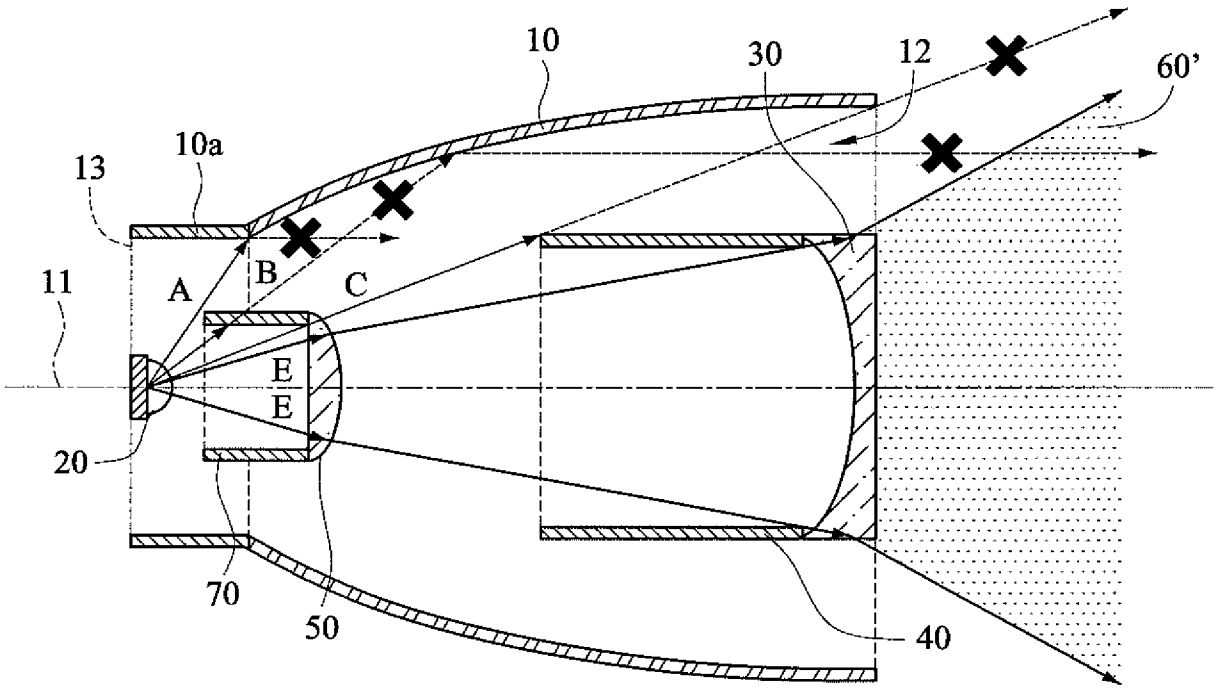
FIG. 3 schematically shows how light rays propagate from the light source of the zoom spotlight in FIG. 2 when the movable lens is at a different position.

As shown in FIG. 2 and FIG. 3, the length of the first light-blocking sleeve 40 is so designed that not a single ray of light emitted by the light source 20 can be projected out of the light exit opening 12 of the reflector 10 directly.

Referring back to FIG. 1, the movable lens 50 is movably provided between the light source 20 and the fixed lens 30 and is located on the central axis 11. In addition, the periphery of the movable lens 50 is fixedly provided with a second light-blocking sleeve 70 which extends toward the light source 20. The diameter D2 of the movable lens is less than the diameter D1 of the fixed lens in order for the movable lens 50 fixedly provided with the second light-blocking sleeve 70 to be movable between the fixed lens 30 and the light source 20.

The movable lens 50 can be a positive lens, a negative lens, a Fresnel lens, a liquid lens, a liquid crystal (LC) lens, or a spatial light modulator (SLM) with phase modulation. The second light-blocking sleeve 70 can be formed of a light-absorbing material or a material with a frosted surface so that light projected from the light source 20 to the second light-blocking sleeve 70 will not penetrate or be reflected by the second light-blocking sleeve 70. Should such penetration or reflection take place, there will be stray light traveling in arbitrary directions.

As the position of the movable lens 50 relative to the fixed lens 30 varies, light projected to and passing through the movable lens 50 may fall on and penetrate the fixed lens 30 in whole or in part, as detailed below with reference to FIG. 2 and FIG. 3.

Referring to FIG. 2, light rays propagating from the light source 20 in direction A or in a direction which forms with the central axis 11 an included angle greater than the included angle between direction A and the central axis 11 are blocked by the bottom light-blocking sleeve 10*a* of the reflector 10 and are therefore prevented from being projected out of the light exit opening 12 of the reflector 10 (the line segments drawn in dashed lines and marked with X represent light ray sections which would have existed if not blocked).

With continued reference to FIG. 2, light rays propagating from the light source 20 in direction B or in a direction which forms with the central axis 11 an included angle less than the included angle between direction A and the central axis 11 and greater than the included angle between direction C and the central axis 11 impinge on and are reflected by the reflector 10 and are consequently projected out of the light exit opening 12 by method of approximate collimating beam or small divergence angle.

Referring again to FIG. 2, light rays propagating from the light source 20 in a direction which forms with the central axis 11 an included angle less than the included angle between direction C and the central axis 11 and greater than the included angle between direction D and the central axis 11 are blocked by the first light-blocking sleeve 40, which, as mentioned above, can be formed of a light-absorbing material and therefore neither allows passage of nor reflects the light rays. In other words, the light rays will not result in stray light that travels in random directions.

Light rays propagating from the light source 20 in direction D are blocked by the second light-blocking sleeve 70 and are therefore prevented from being projected out of the light exit opening 12 (the line segments in FIG. 2 which are drawn in dashed lines and marked with X represent light ray sections which would have existed if not blocked).

Referring to FIG. 2 again, light rays propagating from the light source 20 in a direction which forms with the central axis 11 an included angle less than the included angle between direction D and the central axis 11 and greater than the included angle between direction E and the central axis 11 are blocked by the second light-blocking sleeve 70, which, as previously mentioned, can be formed of a light-absorbing material and therefore neither allows passage of nor reflects the light rays. In other words, the light rays will not result in stray light that travels in random directions.

With continued reference to FIG. 2, light rays propagating from the light source 20 in a direction which forms with the central axis 11 an included angle less than the included angle between direction E and the central axis 11 impinge on the movable lens 50 and are modulated by the movable lens 50 while passing therethrough. The modulated light rays then impinge on the fixed lens 30 and are modulated thereby into a collimated beam 60, which is projected out of the light exit opening 12.

In summary, when the zoom spotlight 100 is in the configuration shown in FIG. 2, the relative positions of the movable lens 50 and the fixed lens 30 are such that a portion of the light projected from the light source 20 is reflected by the reflector 10 and hence projected out of the light exit opening 12. Meanwhile, the remaining portion of the light projected from the light source 20 is blocked by the bottom light-blocking sleeve 10*a* of the reflector 10, the first light-blocking sleeve 40, or the second light-blocking sleeve 70, modulated by the movable lens 50, projected to and modulated by the fixed lens 30, and then cast out of the light exit opening 12 as the collimated beam 60.

Referring to FIG. 3, once the movable lens 50 and the second light-blocking sleeve 70 are moved along the central axis 11 to a position adjacent to the light source 20, most of the light emitted by the light source 20 impinges on the second light-blocking sleeve 70 and the movable lens 50.

It is worth mentioning that the component(s) or method used in the embodiments of the present invention to move the movable lens 50 along the central axis 11 can be implemented by an external driving device (not shown) connected to the second light-blocking sleeve 70.

As shown in FIG. 3, light rays propagating from the light source 20 in direction A or in a direction which forms with the central axis 11 an included angle greater than the included angle between direction A and the central axis 11 are blocked by the bottom light-blocking sleeve 10*a* of the reflector 10 or the second light-blocking sleeve 70 and therefore will not be projected out of the light exit opening 12 of the reflector 10 (the line segments drawn in dashed lines and marked with X represent light ray sections which would have existed if not blocked).

Referring again to FIG. 3, light rays propagating from the light source 20 in direction B or in a direction which forms with the central axis 11 an included angle less than the included angle between direction A and the central axis 11 and greater than the included angle between direction C and the central axis 11 impinge on and are blocked by the second light-blocking sleeve 70 and therefore will not be projected out of the light exit opening 12 (the line segments drawn in dashed lines and marked with X represent light ray sections which would have existed if not blocked).

With continued reference to FIG. 3, light rays propagating from the light source 20 in direction C are modulated by the movable lens 50 while passing therethrough, but the modulate light rays are blocked by the first light-blocking sleeve 40 and therefore will not be projected out of the light exit opening 12 (the line segments drawn in dashed lines and marked with X represent light ray sections which would have existed if not blocked).

Referring to FIG. 3 again, light rays propagating from the light source 20 in a direction which forms with the central axis 11 an included angle less than the included angle between direction C and the central axis 11 and greater than or equal to the included angle between direction E and the central axis 11 are modulated by the movable lens 50 while passing therethrough, and yet the modulated light rays are blocked by the first light-blocking sleeve 40 and therefore will not be projected out of the light exit opening 12 (the line segments drawn in dashed lines and marked with X represent light ray sections which would have existed if not blocked).

Referring again to FIG. 3, light rays propagating from the light source 20 in a direction which forms with the central axis 11 an included angle less than or equal to the included angle between direction E and the central axis 11 impinge on the movable lens 50 and are modulated by the movable lens 50 while passing therethrough. Then, the modulated light rays impinge on the fixed lens 30 and are modulated thereby into a broad beam 60', which is projected out of the light exit opening 12.

In summary, when the zoom spotlight 100 is in the configuration shown in FIG. 3, the relative positions of the movable lens 50 and the fixed lens 30 are such that a portion of the light projected from the light source 20 is blocked by the bottom light-blocking sleeve 10*a* of the reflector 10 or the second light-blocking sleeve 70. Meanwhile, a portion of the light projected from the light source 20 is modulated by the movable lens 50 and is projected to and blocked by the first light-blocking sleeve 40. On the other hand, light rays which are modulated by the movable lens 50 and subsequently projected to and modulated by the fixed lens 30 are cast out of the light exit opening 12 as the broad beam 60'.

In the embodiment described above, the behavior of the movable lens 50 and the fixed lens 30 combined is the behavior of an equivalent positive lens.

Figure 4:
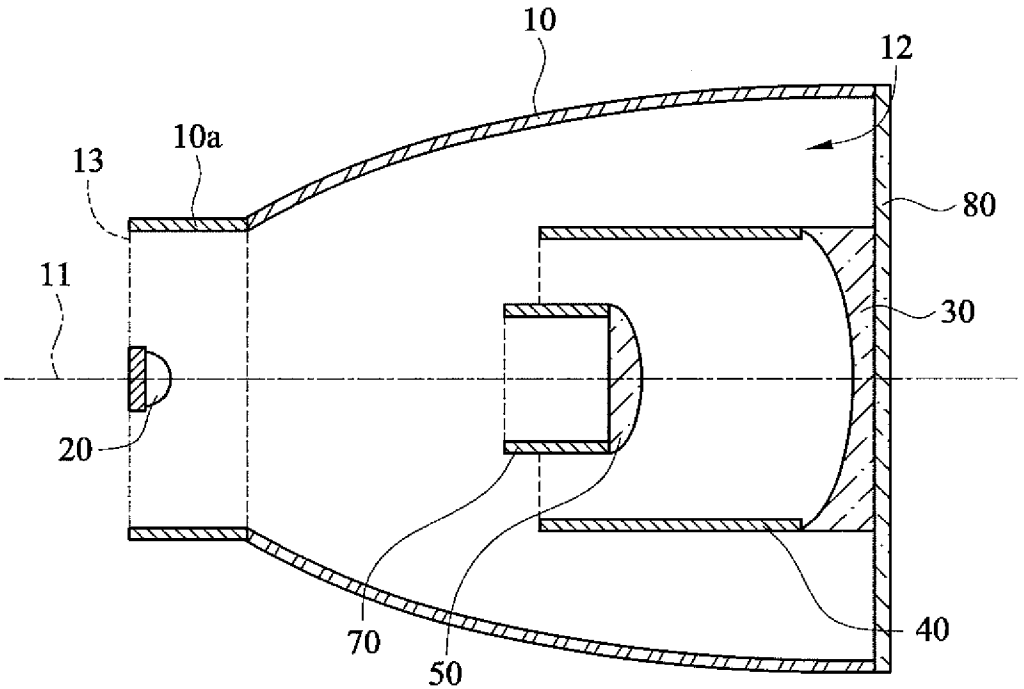
FIG. 4 is a schematic sectional view of the zoom spotlight in another embodiment of the present invention, wherein the zoom spotlight includes a light-permeable plate.
Figure 5:
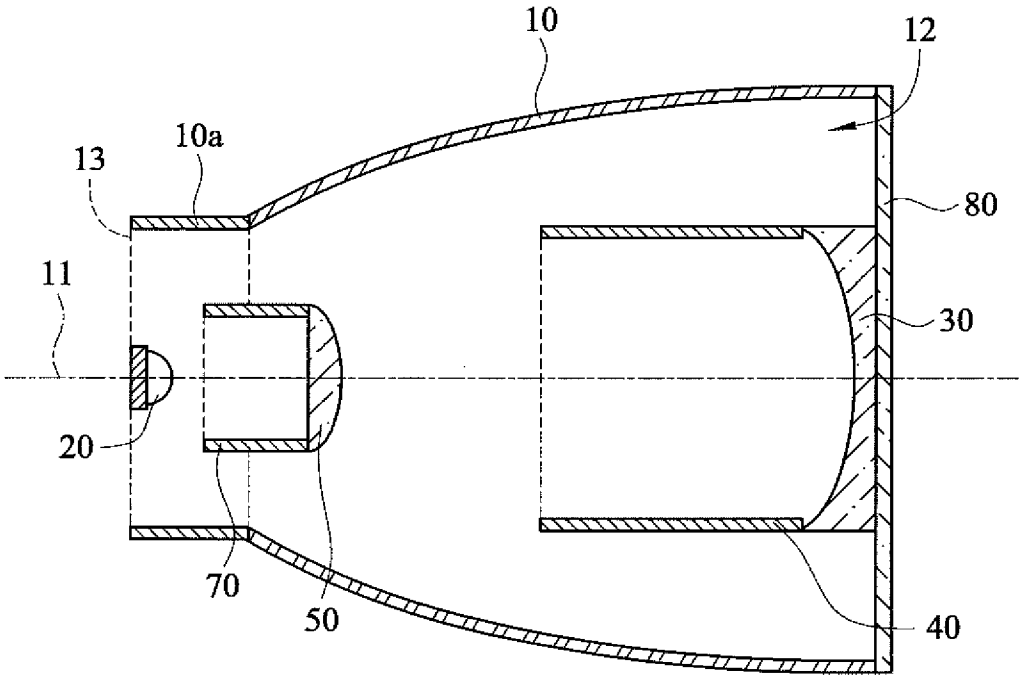
FIG. 5 is another schematic sectional view of the zoom spotlight in FIG. 4, with the movable lens at a different position.

Referring now to FIG. 4 and FIG. 5, the light exit opening 12 of the reflector 10 of the zoom spotlight 100 is further covered with a light-permeable plate 80, which ensures that operation of the zoom spotlight 100 will not be affected by water drops or other foreign matter which may otherwise enter the reflector 10 through the light exit opening 12. It is understood that the bottom side 13 of the reflector 10 can also be covered with a covering element (not shown) to prevent water drops or other foreign matter from entering the reflector 10 through the bottom side 13.

Figure 6:
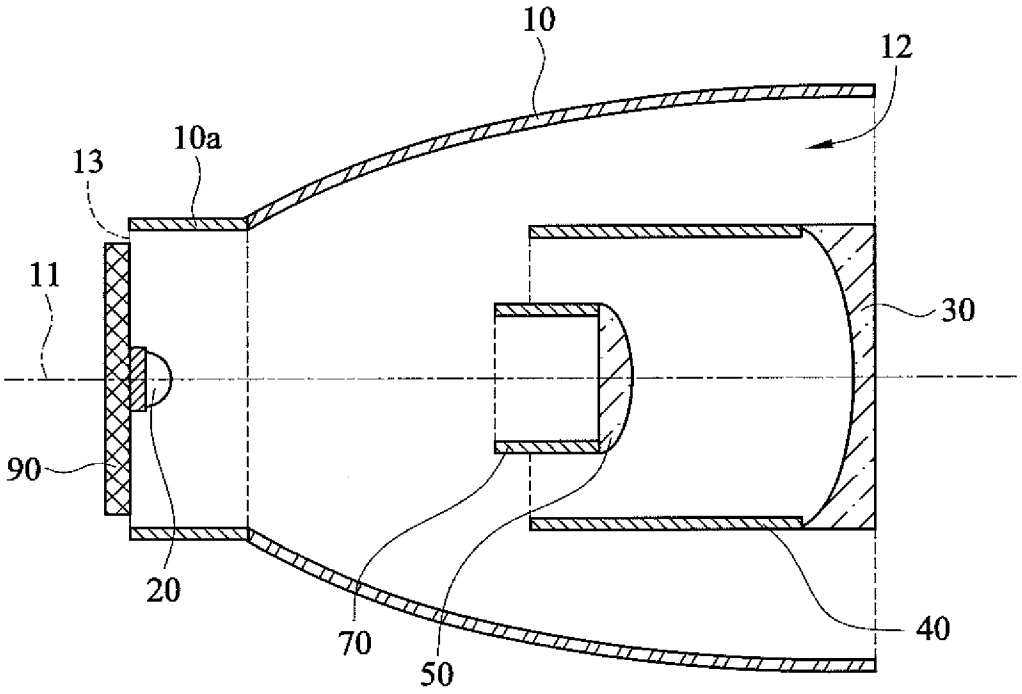
FIG. 6 is a schematic sectional view of the zoom spotlight in yet another embodiment of the present invention, wherein the zoom spotlight includes a heat dissipation mechanism.
Figure 7:
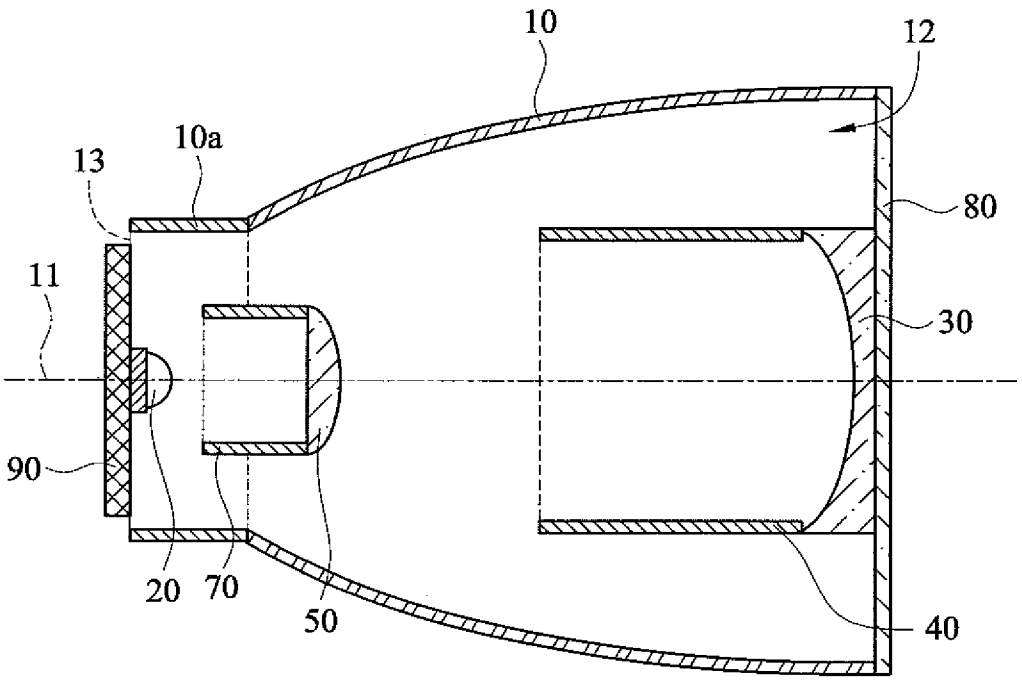
FIG. 7 is a schematic sectional view of the zoom spotlight in still another embodiment of the present invention, wherein the zoom spotlight includes both a light-permeable plate and a heat dissipation mechanism.

In addition, as shown in FIG. 6 and FIG. 7, the zoom spotlight 100 further has a heat dissipation mechanism 90 connected to the light source 20. The present invention imposes no limitations on the size or material of the heat dissipation mechanism 90, provided that the heat dissipation mechanism 90 can increase the area of heat dissipation from the light source 20 and does not interfere with operation of the zoom spotlight 100. In the embodiment shown in FIG. 7, the zoom spotlight 100 has the heat dissipation mechanism 90 as well as the light-permeable plate 80.

It can be known from the foregoing embodiments that the movable lens 50 of the zoom spotlight 100 can be moved along the central axis 11. When the movable lens 50 is close to the fixed lens 30, light rays which are modulated by the movable lens 50 while passing therethrough and which subsequently impinge on and are modulated by the fixed lens 30 are cast out of the light exit opening 12 as the collimated beam 60, thanks to the relative positions of the movable lens 50 and the fixed lens 30.

When the movable lens 50 is moved closer to the light source 20, light rays which are modulated by the movable lens 50 while passing therethrough and which subsequently impinge on and are modulated by the fixed lens 30 are cast out of the light exit opening 12 in a diverging manner, forming a beam ranging between the collimated beam 60 in FIG. 2 and the broad beam 60' in FIG. 3.

When the movable lens 50 is moved to a position even closer to the light source 20, light rays which are modulated by the movable lens 50 while passing therethrough and which subsequently impinge on and are modulated by the fixed lens 30 are cast out of the light exit opening 12 as the broad beam 60', thanks to the relative positions of the movable lens 50 and the fixed lens 30.

In the foregoing embodiments, the first light-blocking sleeve 40, the second light-blocking sleeve 70, or the bottom light-blocking sleeve 10*a* of the reflector 10 provides blockage of light such that no rays of light emitted by the light source 20 can be directly projected out of the light exit opening 12.

The embodiments described above are intended only to demonstrate the technical concept and features of the present invention so as to enable a person skilled in the art to understand and implement the contents disclosed herein. It is understood that the disclosed embodiments are not to limit the scope of the present invention. Therefore, all equivalent changes or modifications based on the concept of the present invention should be encompassed by the appended claims.

What is claimed is:

1. A zoom spotlight, comprising:

a reflector having a central axis, a light exit opening, and a bottom side opposite the light exit opening, wherein the central axis is a line connecting a center point of the light exit opening and a center point of the bottom side;

a light source fixedly provided at the bottom side and located on the central axis;

a fixed lens fixedly provided at the light exit opening and located in the reflector, the fixed lens having an axis coinciding with the central axis, the fixed lens having a periphery fixedly provided with a first light-blocking sleeve extending toward the light source; and a movable lens movably provided between the light source and the fixed lens and located on the central axis, the movable lens having a periphery fixedly provided with a second light-blocking sleeve extending toward the light source.

2. The zoom spotlight of claim 1, wherein the fixed lens and the movable lens form an equivalent positive lens.

3. The zoom spotlight of claim 1, wherein the first light-blocking sleeve is formed of a light-absorbing material or a material having a frosted surface.

4. The zoom spotlight of claim 1, wherein the first light-blocking sleeve, the second light-blocking sleeve, or a bottom light-blocking sleeve of the reflector blocks light such that light rays emitted by the light source cannot be projected out of the light exit opening directly.

5. The zoom spotlight of claim 1, wherein the light source is at least one light-emitting diode (LED) or at least one organic light-emitting diode (OLED).

6. The zoom spotlight of claim 1, wherein the second light-blocking sleeve is formed of a light-absorbing material or a material having a frosted surface.

7. The zoom spotlight of claim 1, wherein the light exit opening is covered with a light-permeable plate.

8. The zoom spotlight of claim 1, further comprising a heat dissipation mechanism connected to the light source.

* * * * *